US009657366B2

(12) United States Patent
Fujii et al.

(10) Patent No.: US 9,657,366 B2
(45) **Date of Patent: *May 23, 2017**

(54) METHOD OF REDUCING DEW POINT OF ATMOSPHERE GAS IN ANNEALING FURNACE, APPARATUS FOR THE SAME AND METHOD OF PRODUCING COLD-ROLLED AND ANNEALED STEEL SHEET

(71) Applicant: JFE Steel Corporation, Tokyo (JP)

(72) Inventors: Takamasa Fujii, Chiba (JP); Masato Iri, Chiba (JP); Nobuyuki Sato, Chiba (JP)

(73) Assignee: JFE Steel Corporation (JP)

( * ) Notice: Subject to any disclaimer, the term of this patent is extended or adjusted under 35 U.S.C. 154(b) by 129 days.

This patent is subject to a terminal disclaimer.

(21) Appl. No.: 14/391,077

(22) PCT Filed: Apr. 5, 2013

(86) PCT No.: PCT/JP2013/002352

§ 371 (c)(1),
(2) Date: Oct. 7, 2014

(87) PCT Pub. No.: WO2013/153790

PCT Pub. Date: Oct. 17, 2013

(65) Prior Publication Data

US 2015/0076751 A1 Mar. 19, 2015

(30) Foreign Application Priority Data

Apr. 9, 2012 (JP) ..... 2012-088088

(51) Int. Cl.
*C21D 9/56* (2006.01)
*C21D 9/52* (2006.01)
(Continued)

(52) U.S. Cl.
CPC ..... *C21D 9/561* (2013.01); *C21D 1/26* (2013.01); *C21D 1/76* (2013.01); *C21D 9/0006* (2013.01);
(Continued)

(58) Field of Classification Search
CPC ..... F01K 25/10; F01K 27/02; C21D 1/26; C21D 9/0006; C21D 9/52; C21D 9/561; C21D 9/562; F27B 9/28; F27D 7/04
(Continued)

(56) References Cited

U.S. PATENT DOCUMENTS 6,228,321 B1 * 5/2001 Umetsu ..... C21D 9/67 148/582
2015/0114528 A1 * 4/2015 Fujii ..... C21D 9/52 148/655

FOREIGN PATENT DOCUMENTS

DE 1 959 713 3/1971
JP 62-290830 12/1987
(Continued)

OTHER PUBLICATIONS

Supplementary European Search Report dated Oct. 9, 2015 of corresponding European Application No. 13775912.2.
(Continued)

*Primary Examiner* — Scott Kastler
*Assistant Examiner* — Michael Aboagye
(74) *Attorney, Agent, or Firm* — DLA Piper LLP (US)

(57) ABSTRACT

Part of an atmosphere gas in a heating zone and/or a soaking zone is sucked out and is cooled through a high-temperature gas passage of a heat exchanger by heat exchange with a gas in a low-temperature gas passage, then cooled through a gas cooler, then dehumidified to a dew point of −45° C. or less in a dryer, then heated through the low-temperature gas passage of the heat exchanger by heat exchange with a gas in the high-temperature gas passage, and returned to the heating zone and/or the soaking zone. Part of gas flowing from the dryer toward the low-temperature gas passage of
(Continued)

the heat exchanger is returned to a cooling zone. These can achieve a low dew point of −45° C. or less with high energy efficiency.

3 Claims, 3 Drawing Sheets

(51) Int. Cl.

| | |
|---|---|
| ***C21D 9/00*** | (2006.01) |
| ***C21D 1/26*** | (2006.01) |
| ***F27D 7/04*** | (2006.01) |
| ***F27B 9/28*** | (2006.01) |
| ***C21D 1/76*** | (2006.01) |

(52) U.S. Cl.
CPC ..... *C21D 9/52* (2013.01); *F27B 9/28* (2013.01); *F27D 7/04* (2013.01); *C21D 9/562* (2013.01)

(58) Field of Classification Search
USPC ..... 266/44, 254, 256, 249; 148/626, 582, 148/601
See application file for complete search history.

(56) References Cited

FOREIGN PATENT DOCUMENTS

| | | | | |
|---|---|---|---|---|
| JP | 2-236229 | | 9/1990 | |
| JP | 10-176225 | | 6/1998 | |
| JP | 11-124622 | * | 5/1999 | ..... C21D 1/76 |
| JP | 2000-104123 | | 4/2000 | |
| JP | 2002-3953 | | 1/2002 | |
| WO | 2012/081719 | | 6/2012 | |

OTHER PUBLICATIONS

Chinese Office Action dated Mar. 10, 2016, of corresponding Chinese Application No. 201380019109.3, along with a Concise Statement of Relevance of Office Action in English.

Yoshitsugu Suzuki et al., "Thermodynamic Analysis of Selective Oxidation Behavior of Si and Mn-added Steel during Recrystallization Annealing," Tetsu-to-Hagané (Bulletin of the Iron and Steel Institute of Japan), vol. 96, No. 1, (2010), pp. 11-20 (English Abstract).

* cited by examiner

METHOD OF REDUCING DEW POINT OF ATMOSPHERE GAS IN ANNEALING FURNACE, APPARATUS FOR THE SAME AND METHOD OF PRODUCING COLD-ROLLED AND ANNEALED STEEL SHEET

TECHNICAL FIELD

This disclosure relates to the field of advantageous production of a steel strip that can reduce the dew point of an atmosphere gas in a continuous annealing furnace and has high wettability and, in particular, relates to a method of reducing the dew point of an atmosphere gas in an annealing furnace, an apparatus for the method, and a method of producing a cold-rolled and annealed steel sheet.

BACKGROUND

It is known that when the dew point of an atmosphere gas in a continuous annealing furnace is −45° C. or less, surface segregation of Mn during annealing can be suppressed, and adhesion of zinc or zinc alloy plating after annealing is improved (see Tetsu To Hagane (Bulletin of the Iron and Steel Institute of Japan), 96-1 (2010), pp. 11-20).

The following are examples of a method in the related art to reduce the dew point of an atmosphere gas in a continuous annealing furnace.

A: A method of supplying another atmosphere gas having a low dew point from the outside of a furnace to a heating zone or a soaking zone (see Japanese Unexamined Patent Application Publication No. 2002-3953).

B: A method of providing a mechanism to circulate a furnace atmosphere gas in the outside of the furnace and thereby performing heat exchange between the circulating high-temperature atmosphere gas and a room-temperature atmosphere gas having a low dew point, which is to be supplied separately to the furnace (see Japanese Unexamined Patent Application Publication No. 62-290830).

C: A method of performing heat exchange between a high-temperature furnace atmosphere gas and an atmosphere gas having a dew point that has been reduced in the outside of a furnace and reducing the dew point with a water adsorption filter (see Japanese Unexamined Patent Application Publication No. 11-124622).

In accordance with method A, the low-temperature gas is directly introduced into the high-temperature furnace. Thus, a large amount of thermal energy is required to maintain the steel strip temperature in the furnace, the gas temperature cannot be controlled, and the energy efficiency is very low.

In accordance with method B, even when the low-temperature gas has a low dew point, the low-temperature gas is mixed with a large amount of atmosphere gas having a high dew point in the furnace. Thus, the dew point of the atmosphere gas in the furnace cannot be sufficiently reduced.

In accordance with method C, as described in Japanese Unexamined Patent Application Publication No. 11-124622, the dew point is reduced to at most −30° C. using the water adsorption filter having a low dehumidification capacity. Thus, a very low dew point (−45° C. or less) of the atmosphere gas cannot be achieved. Furthermore, the energy efficiency is low. Thus, known techniques to reduce the dew point of the atmosphere of a continuous annealing furnace have problems that they cannot achieve a low dew point of −45° C. or less and that they have very low energy efficiency.

SUMMARY

We discovered a means for installing a dryer, for example, of a desiccant method or a compressor method that allows a dew point of −45° C. or less to reduce the dew point of an annealing furnace atmosphere gas and a circulator to reduce the dew point to −45° C., installing a heat exchanger in the circulator to increase or decrease the temperature of the gas, and modifying a gas inflow (gas introduction) into a heating zone and a cooling zone of the furnace to improve energy efficiency.

We thus provide:

(1)

A method for reducing the dew point of a furnace atmosphere gas in a continuous annealing furnace for annealing a metal strip in a reducing atmosphere by passing the metal strip through a heating zone and a cooling zone in this order or through a heating zone, a soaking zone, and a cooling zone in this order, including:

a step (a) for providing a circulator that includes a heat exchanger for heat exchange between a low-temperature gas and a high-temperature gas, a gas cooler for cooling a gas, and a dryer for dehumidifying a gas to a dew point of −45° C. or less;

a step (b) for sucking part of the atmosphere gas from the heating zone and/or the soaking zone;

then a step (c) for passing the sucked part of the atmosphere gas through a high-temperature gas passage of the heat exchanger and decreasing the temperature of the sucked part of the atmosphere gas by heat exchange with a gas in a low-temperature gas passage;

then a step (d) for passing the part of the atmosphere gas having a decreased temperature through the gas cooler to further cool the part of the atmosphere gas;

then a step (e) for dehumidifying the further cooled part of the atmosphere gas to a dew point of −45° C. or less in the dryer;

then a step (f) for passing the dehumidified part of the atmosphere gas through the low-temperature gas passage of the heat exchanger to increase the temperature of the dehumidified part of the atmosphere gas by heat exchange with a gas in the high-temperature gas passage;

then a step (g) for returning the part of the atmosphere gas having an increased temperature to the heating zone and/or the soaking zone; and simultaneously with the step (f) and the step (g), a step (h) for returning part of gas flowing from the dryer toward the low-temperature gas passage of the heat exchanger directly to the cooling zone without passing through the heat exchanger.

(2)

An apparatus for reducing the dew point of an atmosphere gas in a continuous annealing furnace for annealing a metal strip in a reducing atmosphere by passing the metal strip through a heating zone 1 and a cooling zone 2 in this order or through a heating zone, a soaking zone, and a cooling zone in this order, including:

a gas passage including a heat exchanger 9 for heat exchange between a low-temperature gas and a high-temperature gas, a gas cooler 10 for cooling a gas, a dryer 11 for dehumidifying a gas to a dew point of −45° C. or less, and a gas distributor 13, wherein the apparatus includes a gas passage extending from the heating zone 1 and/or the soaking zone through a gas passage 15 to a high-temperature gas passage of the heat exchanger 9 and through the gas cooler 10 to the dryer 11, a gas passage 16 extending from the dryer 11 through the gas distributor 13 to a low-temperature gas passage of the heat exchanger 9 and from the heat exchanger 9 to the heating zone and/or the soaking zone, and a gas passage 17 for returning part of gas flowing from the dryer 11 toward the low-temperature gas passage of the heat exchanger 9 directly to the cooling zone through the gas distributor 13 but without passing through the heat exchanger 9.

(3)

A method for producing a cold-rolled and annealed steel sheet, including continuously annealing a cold-rolled steel strip, wherein the dew point of an atmosphere gas in a continuous annealing furnace is reduced by the method for reducing the dew point of an atmosphere gas in an annealing furnace according to (1) during the continuous annealing.

Part of an atmosphere gas in the heating zone and/or the soaking zone is sucked out and is cooled through a high-temperature gas passage of the heat exchanger by heat exchange with a gas in a low-temperature gas passage, is then further cooled through the gas cooler, is then dehumidified to a dew point of −45° C. or less in the dryer, is then heated through the low-temperature gas passage of the heat exchanger by heat exchange with a gas in the high-temperature gas passage, and is returned to the heating zone and/or the soaking zone. Part of gas flowing from the dryer toward the low-temperature gas passage of the heat exchanger is returned directly to the cooling zone without passing through the heat exchanger. These can achieve a very low dew point of −45° C. or less in the annealing furnace and significantly improve energy efficiency.

REFERENCE SIGNS LIST

Figure 1:
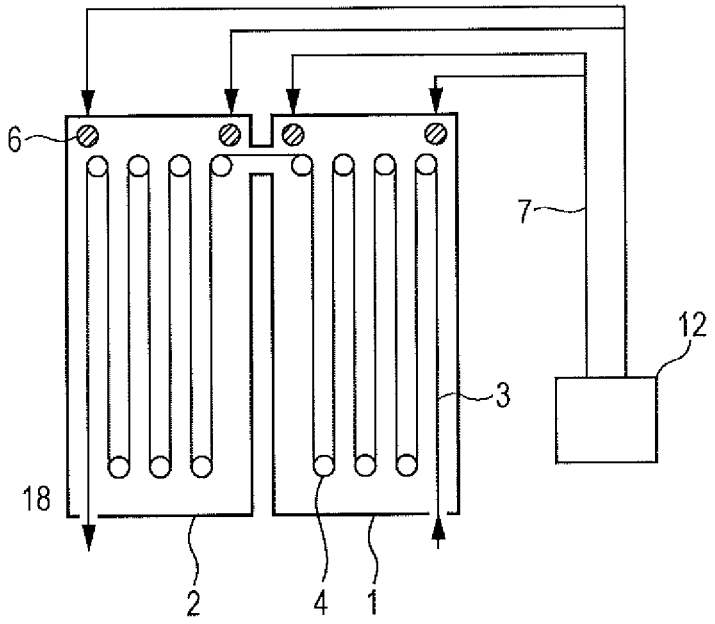
FIG. 1 (PRIOR ART)
FIG. 1 is a schematic view of Conventional Example 1.

1 Heating zone
2 Cooling zone
3 Steel strip
4 Roller
5 Suction port
6 Inlet
7 Atmosphere gas pipe
8 Circulator
9 Heat exchanger
10 Gas cooler
11 Dryer (dehumidifier)
12 Equipment for supplying another atmosphere gas
13 Gas distributor
15 Gas flow path from heating zone
16 Gas flow path to heating zone
17 Gas flow path to cooling zone
18 Annealing furnace outlet

DETAILED DESCRIPTION

When a cold-rolled steel strip is continuously annealed and subsequently plated with zinc or a zinc alloy, the adhesion of plating depends greatly on the dew point in an annealing furnace. It is known that this results from the amount of Mn oxide on the surface of the steel strip. At a dew point in the vicinity of −10° C., Mn oxide is present within an oxide film on the surface of the steel strip and rarely found on the surface of the steel strip. At a dew point of −45° C. or less, Mn oxide is negligibly produced. At an intermediate dew point in the vicinity of −35° C. (−15° C. to −40° C.), a large amount of Mn oxide is produced on the surface of the steel strip and inhibits the adhesion of plating. Thus, we considered providing the annealing furnace with a circulator equipped with a dryer that allows a dew point of −45° C. or less in order to achieve a very low dew point to prevent concentration of Mn oxide on the surface of the steel strip.

Attention is now focused on the temperatures of an atmosphere gas sucked from the furnace into the circulator (hereinafter referred to as a sucked gas) and an atmosphere gas introduced from the circulator into the furnace (hereinafter referred to as an introduced gas). The desired atmosphere gas temperature in the annealing furnace is different in a heating zone, a soaking zone, and a cooling zone. More specifically, the sucked gas is cooled to approximately room temperature in a gas cooler before entering the dryer, dehumidified in the dryer, and returned to the furnace. Thus, if a low-temperature gas is directly introduced into a high-temperature region such as the heating zone or the soaking zone, a high temperature required to anneal the steel strip cannot be maintained. For this reason, the temperature of the introduced gas from the circulator must be increased.

We installed a heat exchanger between the furnace and the gas cooler. More specifically, a high-temperature gas sucked from the heating zone or the soaking zone of the furnace (sucked gas) is cooled in the cooler before entering the dryer. Utilizing thermal energy resulting from the temperature difference, therefore, the gas cooled in the gas cooler and dehumidified in the dryer can be heated. Thus, thermal energy discharged from the gas cooler can be effectively utilized. A high-temperature gas sucked from the heating zone or the soaking zone of the furnace is passed through the heat exchanger, cooled in the gas cooler, dehumidified in the dryer, heated in the heat exchanger, and then returned to the heating zone or the soaking zone of the furnace.

Furthermore, since the gas temperature after cooling with the gas cooler is lower than the temperature of the cooling zone of the furnace, part of gas cooled in the gas cooler, dehumidified in the dryer, and returned directly to the cooling zone without passing through the heat exchanger can reduce the temperature and the dew point of the cooling zone, thus further improving energy efficiency.

Unlike a water adsorption filter made of activated alumina, alternately operated and stopped, and having a low dehumidification capacity as described in Japanese Unexamined Patent Application Publication No. 11-124622, a dryer preferably has a high dehumidification capacity, for example, of a desiccant method for continuous dehumidification using calcium oxide, zeolite, silica gel, or calcium chloride or a compressor method using an alternative chlorofluorocarbon.

EXAMPLES

FIGS. 1 to 7 illustrate the structure and gas passages of a continuous annealing furnace having a heating zone and a cooling zone according to Example, Comparative Example, and Conventional Examples.

FIG. 1 illustrates Conventional Example 1 described in Japanese Unexamined Patent Application Publication No.

2002-3953. Atmosphere gas supply equipment 12 directly supplies another low-temperature atmosphere gas to a heating zone 1 and a cooling zone 2.

Figure 2:
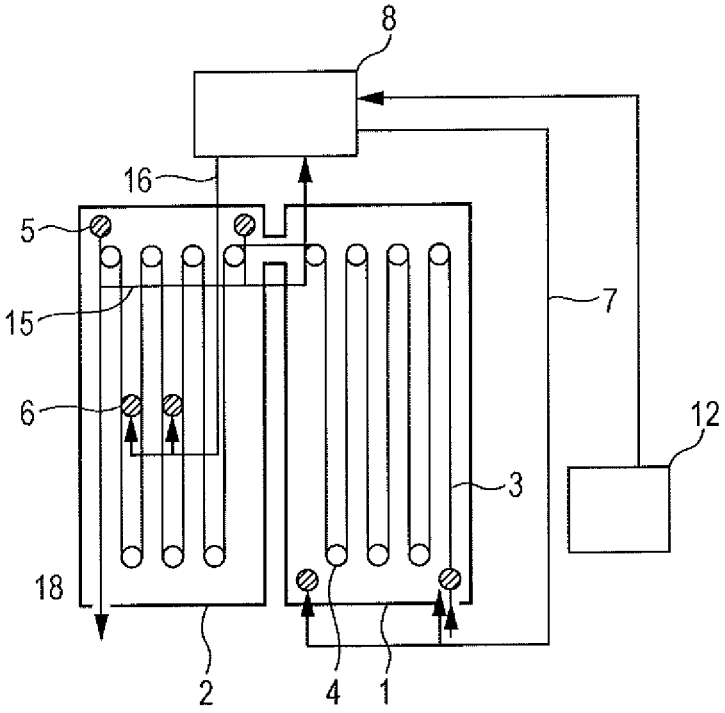
FIG. 2 (PRIOR ART)
FIG. 2 is a schematic view of Conventional Example 2.
Figure 3:
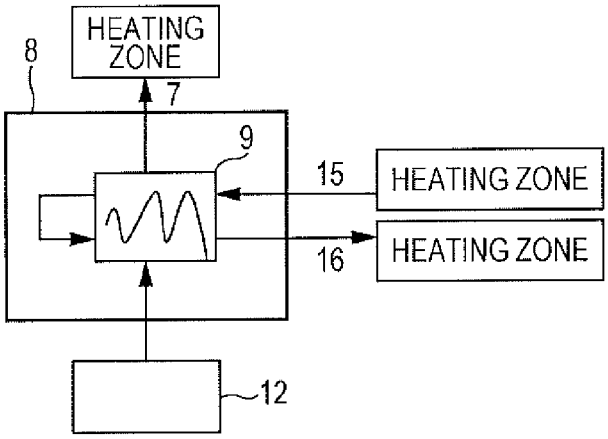
FIG. 3 (PRIOR ART)
FIG. 3 is a schematic view of a circulation system according to Conventional Example 2.

FIGS. 2 and 3 illustrate Conventional Example 2 described in Japanese Unexamined Patent Application Publication No. 62-290830. A gas sucked from a cooling zone 2 enters a circulator 8 through a flow path 15, passes through a heat exchanger 9 to heat a gas from atmosphere gas supply equipment 12, and returns to the cooling zone 2 through a flow path 16. The low-temperature atmosphere gas supplied from the gas supply equipment 12 is heated in the heat exchanger 9 and is introduced into a heating zone 1 through an atmosphere gas pipe 7.

Figure 4:
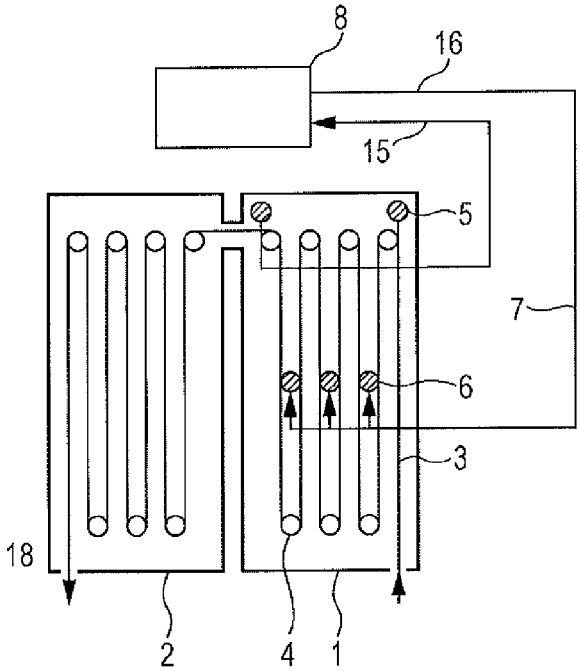
FIG. 4 is a schematic view of Comparative Example 1.
Figure 5:
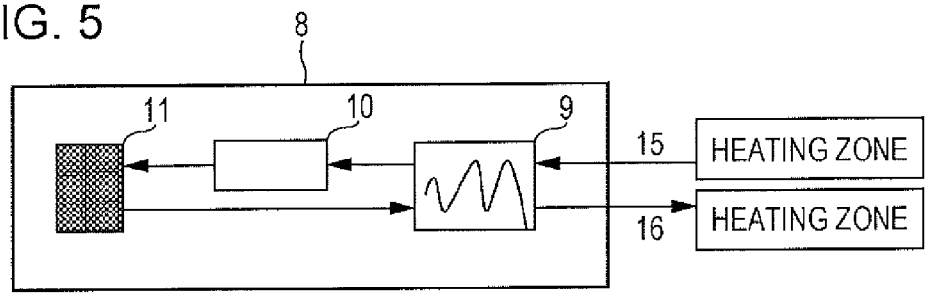
FIG. 5 is a schematic view of a circulation system according to Comparative Example 1.

FIGS. 4 and 5 illustrate Comparative Example 1. A gas sucked from a heating zone 1 is introduced into a circulator 8 through a flow path 15, cooled in a heat exchanger 9 with a gas that has been dehumidified in a dryer 11, further cooled in a gas cooler 10, dehumidified in the dryer 11, heated in the heat exchanger 9 with a gas from the heating zone 1, and returned to the heating zone 1 through a flow path 16.

Figure 6:
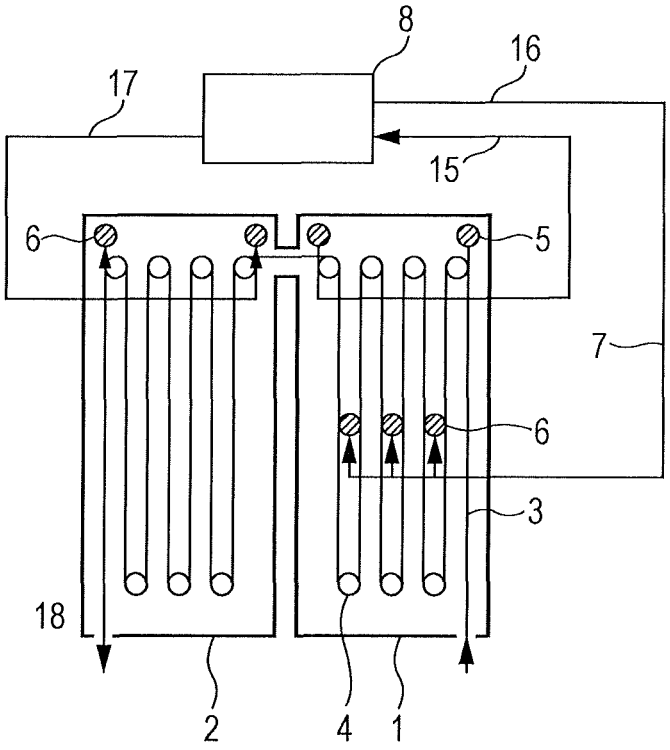
FIG. 6 is a schematic view of one of our examples.
Figure 7:
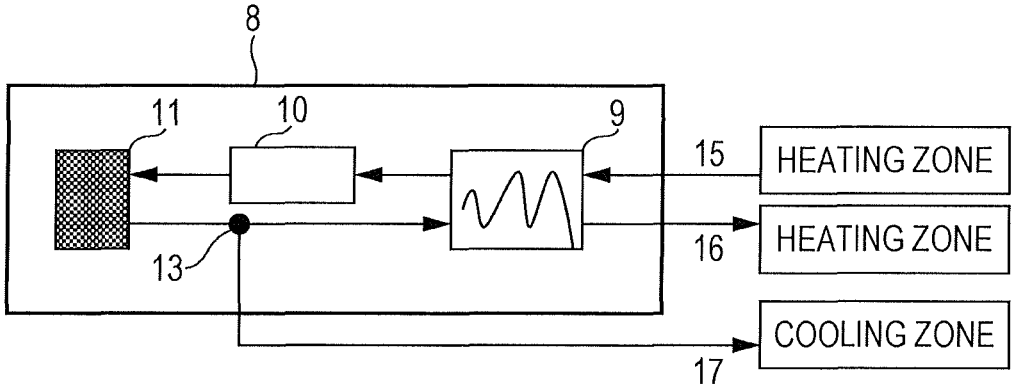
FIG. 7 is a schematic view of a circulation system according to one of our examples.

FIGS. 6 and 7 illustrate one of our examples and correspond to (1) and (2) in the Summary. A gas sucked from a heating zone 1 is introduced into a circulator 8 through a flow path 15, cooled in a heat exchanger 9 with a gas that has been dehumidified in a dryer 11, further cooled in a gas cooler 10, dehumidified in the dryer 11, and distributed with a gas distributor 13. One part of the distributed gas is introduced into the heat exchanger 9, heated therein with a gas from the heating zone 1 and returned to the heating zone 1 through a flow path 16. The remainder of the distributed low-temperature gas is returned directly to a cooling zone 2 through a flow path 17.

The conditions of these sucked gases and introduced gases were changed. Table 1 shows the dew points of the sucked gases and the dew points of the introduced gases passing through the gas passages in Example, Comparative Example, and Conventional Examples, exhausted heat energy during the passage, and the adhesion of plating of a steel strip after annealing. Table 1 shows that the dew points of the gases introduced into the annealing furnaces in Examples and Comparative Examples No. 1 to No. 6 are satisfactorily lower than the target temperature of −45° C., as compared to Conventional Examples No. 7 to No. 10. Furthermore, the dew points in the furnaces measured upstream from an annealing furnace outlet 18 in Examples and Comparative Examples No. 1 to No. 6 are also satisfactorily lower than −45° C.

The adhesion of zinc alloy plating was examined in zinc alloy plating of a steel strip after continuous annealing in accordance with a JIS-H8504(g) tape test method (a chipping test method). As a result, Examples and Comparative Examples No. 1 to No. 6 had satisfactorily strong adhesion, but Conventional Examples No. 7 to No. 10 had coating defects.

The exhausted heat energy in Examples No. 4 to No. 6 is approximately half the exhausted heat energy in Comparative Examples No. 1 to No. 3 and ¼ to 1/10 times and much smaller than the exhausted heat energy in Conventional Examples No. 7 to No. 10. Thus, our examples have very high energy efficiency.

TABLE 1

| | Sucked gas | | | | Introduced gas | | | | Dew point in furnace measured upstream from | | | Adhesion of | |
|---|---|---|---|---|---|---|---|---|---|---|---|---|---|
| No. | Position | Flow rate $Nm^3/Hr$ | Temperature ° C. | Dew point ° C. | Position | Flow rate $Nm^3/Hr$ | Temperature ° C. | Dew point ° C. | continuous annealing furnace outlet (° C.) | Exhausted heat energy $kJ/Nm^3$ | Dehumidification method | Zn alloy plating after continuous annealing | Note |
| 1 | Heating zone | 750 | 800 | −20 | Heating zone | 750 | 500 | −50 | −45 | 86 | Calcium oxide | Strong | Comparative example 1 |
| 2 | Heating zone | 1000 | 850 | −25 | Heating zone | 1000 | 650 | −55 | −47 | 80 | Zeolite | Strong | Comparative example 1 |
| 3 | Heating zone | 2000 | 750 | −15 | Heating zone | 2000 | 450 | −60 | −50 | 75 | Silica gel | Strong | Comparative example 1 |
| 4 | Heating zone | 1000 | 800 | −20 | Heating zone<br>Cooling zone | 500<br>500 | 550<br>50 | −51 | −47 | 38 | Zeolite | Strong | Example |
| 5 | Heating zone | 2000 | 900 | −10 | Heating zone<br>Cooling zone | 1500<br>500 | 600<br>25 | −55 | −52 | 45 | Calcium chloride | Strong | Example |
| 6 | Heating zone | 3000 | 750 | −30 | Heating zone<br>Cooling zone | 1000<br>2000 | 600<br>5 | −70 | −66 | 40 | Compressor method | Strong | Example |
| 7 | Cooling zone | 0 | — | — | Cooling zone | 3000 | 25 | −50 | −35 | 253 | — | Coating defect | Conventional example 1 |
| 8 | Heating zone | 0 | — | — | Heating zone | 1500 | 5 | −45 | −32 | 402 | — | Coating defect | Conventional example 1 |
| 9 | Heating zone | 500 | 950 | −20 | Heating zone | 500<br>(250) | 700<br>200 | −20<br>−40 | −21 | 155 | — | Coating defect | Conventional example 2 |
| 10 | Heating zone | 4000 | 800 | −15 | Heating zone | 4000<br>(1000) | 600<br>400 | −15<br>−35 | −20 | 189 | — | Coating defect | Conventional example 2 |

[Note]
A flow rate in parentheses is the flow rate of another supplied gas

The invention claimed is:

1. An apparatus that reduces a dew point of an atmosphere gas in a continuous annealing furnace that anneals a metal strip in a reducing atmosphere by passing the metal strip through a heating zone and a cooling zone in this order or through a heating zone, a soaking zone, and a cooling zone in this order, comprising:

a circulator including a heat exchanger that exchanges heat between a low-temperature gas and a high-temperature gas, a gas cooler that cools a gas, a dryer that dehumidifies a gas to a dew point of −45° C. or less by utilizing a desiccant or compressor, and a gas distributor, wherein the apparatus further includes a first gas passage extending from the heating zone and/or the soaking zone through a gas passage to a high-temperature gas passage which is installed in the heat exchanger and through the gas cooler to the dryer, a second gas passage extending from the dryer through the gas distributor to a low-temperature gas passage of the heat exchanger and from the heat exchanger to the heating zone and/or the soaking zone, and a third gas passage that returns part of gas flowing from the dryer toward the low-temperature gas passage of the heat exchanger directly to the cooling zone through the gas distributor but without passing through the heat exchanger.

2. A method of reducing the dew point of a furnace atmosphere gas in a continuous annealing furnace that anneals a metal strip in a reducing atmosphere by passing the metal strip through a heating zone and a cooling zone in this order or through a heating zone, a soaking zone, and a cooling zone in this order, comprising:

(a) providing the apparatus that reduces the dew point of an atmosphere as in a continuous annealing furnace according to claim 1;

(b) sucking part of the atmosphere gas from the heating zone and/or the soaking zone;

(c) passing the sucked part of the atmosphere gas through a high-temperature gas passage of the heat exchanger and decreasing the temperature of the sucked part of the atmosphere gas by heat exchange with a gas in a low-temperature gas passage;

(d) passing the part of the atmosphere gas having a decreased temperature through the gas cooler to further cool the part of the atmosphere gas;

(e) dehumidifying the further cooled part of the atmosphere gas to a dew point of −45° C. or less in the dryer;

(f) passing the dehumidified part of the atmosphere gas through the low-temperature gas passage of the heat exchanger to increase the temperature of the dehumidified part of the atmosphere gas by heat exchange with a gas in the high-temperature gas passage;

(g) returning the part of the atmosphere gas having an increased temperature to the heating zone and/or the soaking zone; and (h) simultaneously with (f) and (g), returning part of gas flowing from the dryer toward the low-temperature gas passage of the heat exchanger directly to the cooling zone without passing through the heat exchanger.

3. A method of producing a cold-rolled and annealed steel sheet, comprising continuously annealing a cold-rolled steel strip, wherein the dew point of an atmosphere gas in a continuous annealing furnace is reduced by the method according to claim 2 during the continuous annealing.

* * * * *